US005196869A

United States Patent [19]

Park

[11] Patent Number: 5,196,869

[45] Date of Patent: Mar. 23, 1993

[54] RECORDING PAPER CLAMPING APPARATUS FOR A VIDEO PRINTER

[75] Inventor: Geun-Yong Park, Suwon, Rep. of Korea

[73] Assignee: Samsung Electronics Co., Ltd., Suwon, Rep. of Korea

[21] Appl. No.: 808,725

[22] Filed: Dec. 17, 1991

[30] Foreign Application Priority Data

Feb. 12, 1991 [KR] Rep. of Korea ..... 1991-2343

[51] Int. Cl.[5] ..... B41J 13/22

[52] U.S. Cl. ..... 346/138; 271/277

[58] Field of Search ..... 271/277; 346/138, 76 PH

[56] References Cited

U.S. PATENT DOCUMENTS 4,111,119 9/1978 Takizawa et al. ..... 271/277
4,517,575 5/1985 Kakimoto et al. ..... 271/277
4,660,825 4/1987 Umezawa ..... 271/277

*Primary Examiner*—Benjamin R. Fuller
*Assistant Examiner*—Huan Tran
*Attorney, Agent, or Firm*—Robert E. Bushnell

[57] ABSTRACT

A paper holder of a video printer for improving an accuracy of a printing cycle by eliminating a position error of color of Y, M and C, and for reducing a printing time by discharging the record paper immediately after a printing cycle is complete.

5 Claims, 4 Drawing Sheets

RECORDING PAPER CLAMPING APPARATUS FOR A VIDEO PRINTER

BACKGROUND OF THE INVENTION

The present invention relates to an apparatus for printing video color signals by a method of the consecutive placing of three colors of Yellow (Y), Magenta (M) and Cyan (C), and more particularly to the apparatus for printing three video color signals exactly on a record paper with high quality picture by enabling a drum along with a paper holder unitedly or separately to rotate and to move upward and downward in perpendicular to an axis of the clutch and drum.

Generally a video color printer adopts a heat conduction sublimation method for printing all colors and making a tonal expression freely. The video color printer performs a full color printing by rotating a record paper with a color ribbon applied with three colors of Y, M and C. An amount of dyes of Y, M and C to be sublimated in printing is controlled by a heating value from a thermal printing head (T.P.H.).

With reference to FIG. 1, the video printer includes an ink ribbon 1 applied consecutively with three colors of Y, M and C, and the T.P.H. 4 for pressing a record paper 3 fixed on and rotating along with a platen drum 2 selectively. By rotating the platen drum 2 along with the record paper 3 fixed on its surface, the record paper 3 and the ink ribbon are advanced at the same speed as that of the platen drum 2. Each dye of Y, M and C on the ink ribbon 1 is consecutively sublimated by a heat generated from the T.P.H. 4 and is absorbed into the record paper 3. Because a synthesized color is varied according to an amount of each absorbed color of Y, M and C, it is possible to print all colors.

Accordingly because the platen drum 2 is rotated by three revolutions for a print-completion, an apparatus for fixing the record paper on the platen drum, is required. There is disclosed such an apparatus as shown in FIG. 2.

The paper holder 5 is installed over a side wall of a drum 2 and set by a tension spring 6. While the drum 2 rotates about the hinge 7, the paper holder 5 moves apart: from the drum 2 and presses the drum 2 by an operation of a slider 8, so that the paper holder 5 can grip the record paper 3 supplied from a paper cartridge, and the drum 2 with the paper 3 fixed by the paper holder 5 can rotate anti-clockwise to perform a printing operation.

After completing the printing of three colors of Y, M and C by three revolutions of the drum 2, the platen drum 2 rotates clockwise so as to move an end tip of the record paper to a paper discharging cartridge and the paper holder releases the printed paper by the slider 8.

Consequently it requires more time and a sophisticated mechanism for the conventional device in order to rotate the drum in both directions to complete the printing of three colors of Y, M and C.

SUMMARY OF THE INVENTION

It is an object of the present invention to provide a paper holder of a video printer for improving an accuracy of printing by eliminating a position error of color of Y, M and C, and for reducing a printing time by discharging the record paper immediately after a printing operation is complete.

According to the present invention, there is provided a video printer having a paper holder for fixing a heat conduction record paper by sublimating three dyes of Y, M and C, including the paper holder installed between a pressure disc and a clutch disc and inserted into a driving shaft, for pressing a platen drum; the platen drum having a platen shaft for rotating about the driving shaft; the clutch disc installed on both sides of the platen shaft of the platen drum; a clutch plate installed about the driving shaft, for pressing the pressure disc selectively by a lever; and the pressure disc for engaging with the clutch disc.

BRIEF DESCRIPTION OF THE DRAWINGS

For a better understanding of the invention, and to show how the same may be carried into effect, reference will now be made, by way of example, to the accompanying diagrammatic drawings, in which.

DETAILED DESCRIPTION OF PREFERRED EMBODIMENT

Figure 1:
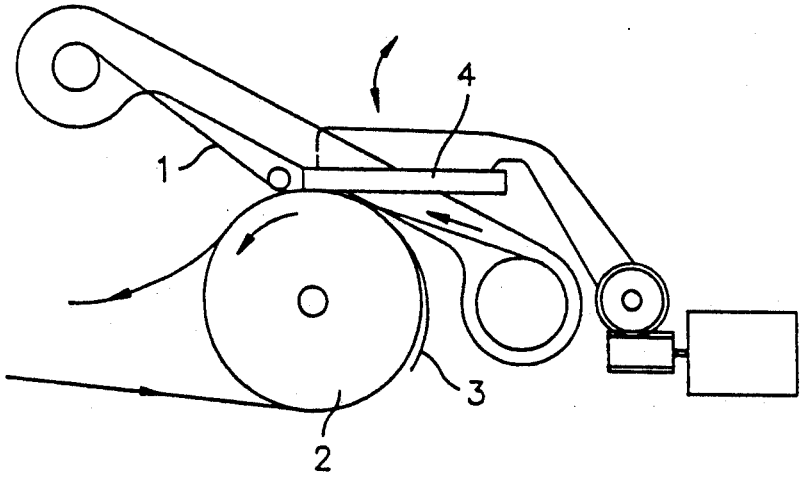
(PRIOR ART) FIG. 1
FIG. 1 is a schematic diagram of operation of a general video printer.
Figure 2:
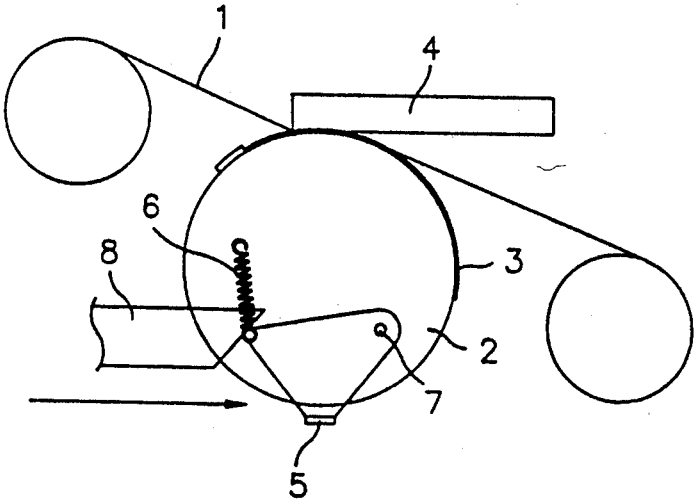
(PRIOR ART) FIG. 2
FIG. 2 is a view of configuration of a conventional paper holder installed in a video printer.
Figure 3:
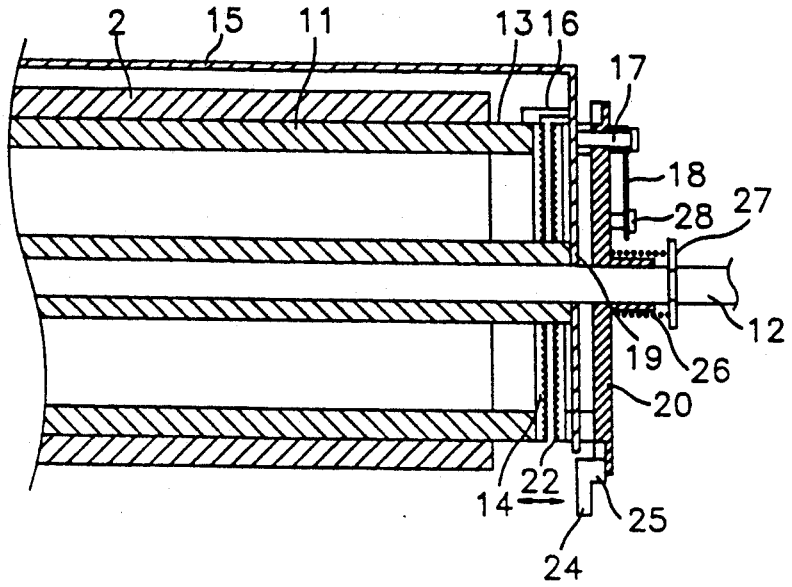
FIG. 3 is a sectional view of configuration of a drum and paper holder according to the present invention.
Figure 4:
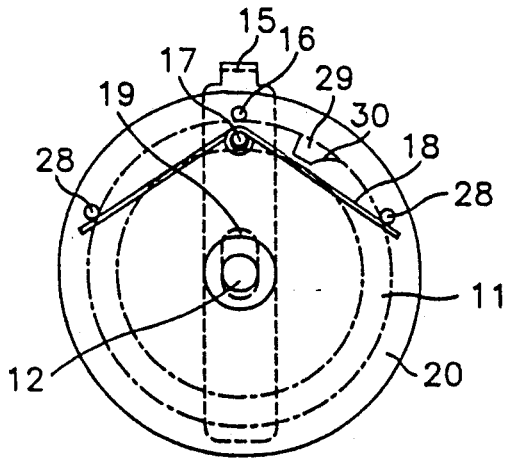
FIG. 4 is a side view of configuration of the drum and paper holder of FIG. 3.

With reference to FIGS. 3 and 4, a platen drum 2 includes a platen shaft 11 and a driving shaft 12. The cylindrical platen shaft 11 is longer than the platen drum 2 in length, so that part of the side surface of the platen shaft 11 is attached to the inner side surface of the platen drum 12, and the other part thereof is exposed to form a sliding surface 13. A disc clutch 14 is installed on both ends of the platen shaft 11 being vertically contact in with the sliding surface 13.

A paper holder 15 comprises the horizontal bar extending over the side surface of the platen drum 2 and both side vertical bars extending from a top to a bottom surface of the platen drum 2. On inner wall of the vertical bar, is formed a sliding pin 16 for sliding over the sliding surface 13. A second disc clutch 22 is installed between a first disc clutch 14 of the platen shaft 11 and the vertical bar of the paper holder 15. The first and second disc clutches 14 and 22 are made of a friction face or latch. The second disc clutch 22 is engaged in or detached from the first disc clutch 14 in accordance with a jaw 25 of a lever 24 so as to rotate the platen drum 2 along with the paper holder 15 or only platen drum 2 respectively. On outer wall of the vertical bar of the paper holding bar 15, is formed a fix pin 17 in which a torsion spring 18 is hooked up.

A cut 29 having a cam 30 is formed on the sliding surface 13 so as to catch and release the sliding pin 16 selectively. A loop hole 19 is formed around an outer surface of the driving shaft 12, enabling the paper holder 15 to move upward and downward.

A clutch pressure plate 20 is installed over the outer side of the paper holder 15. At the upper portion of the clutch pressure plate 20 there is a hole in which the fix pin 17 is inserted, and at lower portion thereof there is the jaw 25 of the lever 24 operated by an external driving device.

A compression coil spring 26 for pressing the clutch pressure plate 20 is installed around the exposed driving shaft 12 and is supported by a stop ring 27 so as to make the clutch pressure plate 20 receive a compression force of the compression coil spring 26 towards bottom or top surface of the drum 2 continuously.

The torsion spring 18 is hooked by the fix pin 17 inserted into the hole formed on the upper portion of clutch pressure plate 20 and is supported by two lugs 28 formed on an outer surface of the clutch pressure plate 20.

With reference to FIGS. 3 and 5, the operation of the present invention will be described.

Figure 5A:
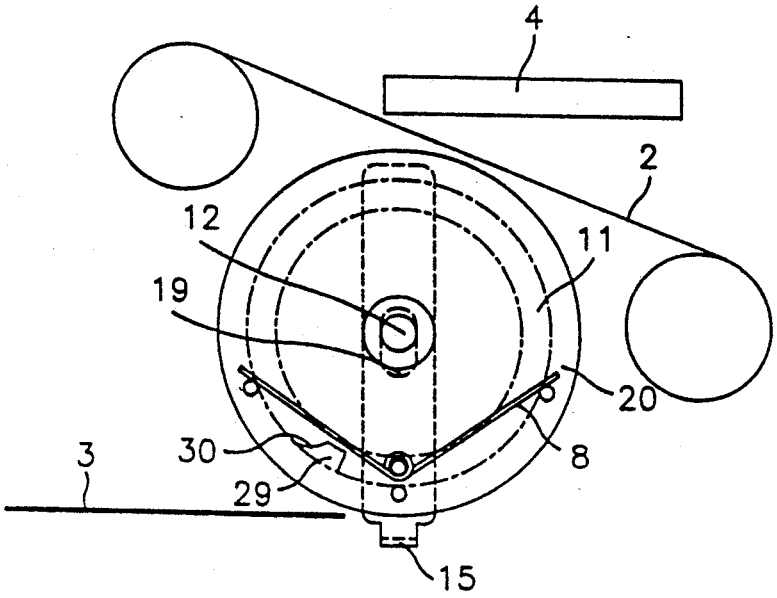
FIG. 5 is a view of illustration of printing operation of the drum and paper holder according to the present invention.
Figure 5B:
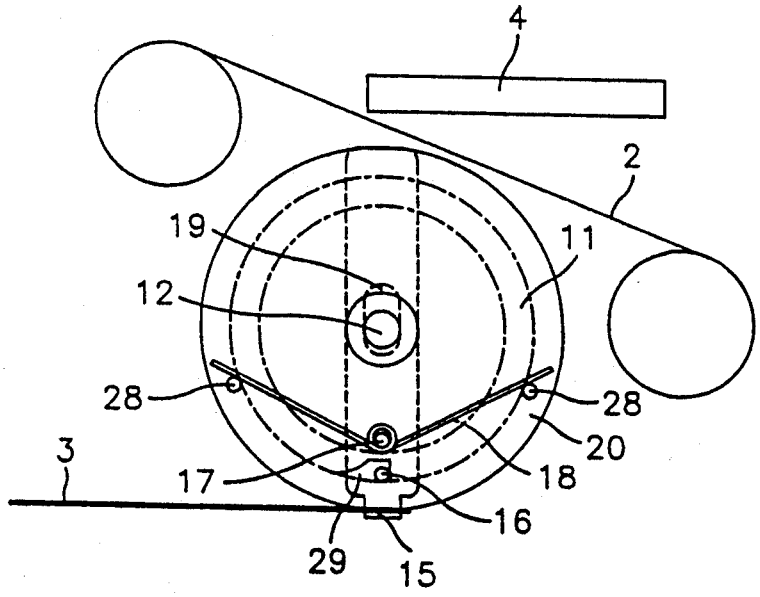

The second disc clutch 22 is separated from the first disc clutch 14 by moving the lever 24 to a side of the clutch pressure plate 20 when a foremost tip of the record paper 3 is advanced to a given position under the paper holder 15, as shown in FIG. 5A. Thereby, only the platen drum 2 fixed on the driving shaft 12 rotates while the clutch pressure plate 20 and the paper holder 15 is stationary. Then when the cut 29 formed in the sliding surface 13 of the platen shaft 11 reaches a position of the sliding pin 16 of the paper holder 15, the sliding pin 16 is dropped into the cut 29 by a force of the torsion spring 18, and the paper holder 15 moves downward along the loop hole 19. Accordingly the foremost tip of the record paper is fixed on the platen drum 2 by the paper holder 15 as shown in FIG. 5B.

Thereafter, the jaw 25 of the lever 24 releases the clutch pressure plate 20, moving the clutch pressure plate 20 toward the second disc clutch 22 by the compression coil spring 26. The first disc clutch 14 engages the second disc clutch 22. Accordingly the paper holder 15 and the clutch pressure plate 20 are rotated together with the platen drum 2 simultaneously.

Figure 5C:
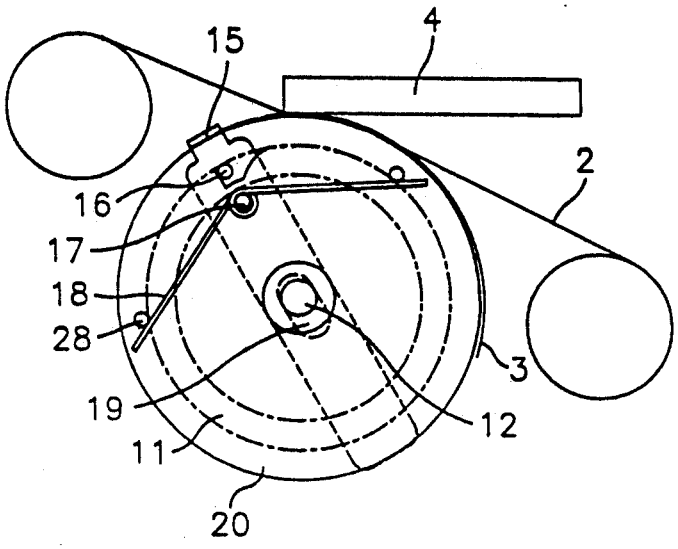

When the paper holder 15 arrives at a given position (printing position) by rotating as shown in FIG. 5C, the T.P.H. 4 moves downward to press the ink ribbon 1 on the record paper 3 for enabling a printing operation.

After printing of the colors of Y and M in the above-described method, when the record paper holder 15 is at a printing position, the T.P.H. 4 presses the record paper and the ink ribbon 1, and just thereafter the clutch pressure plate 20 is pushed right hand by the jaw 25 of the lever 24, releasing the second disc clutch 22 from the first disc clutch 14 of the platen shaft 11. Accordingly the paper holder 15 and the clutch pressure plate 20 stop rotating.

Figure 5D:
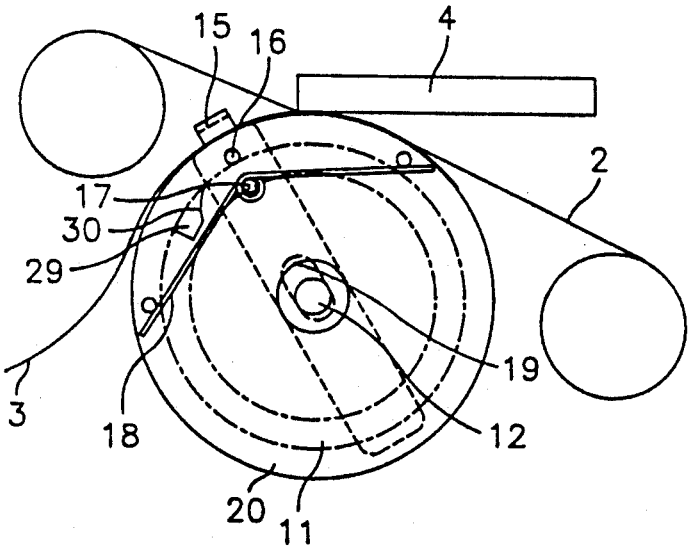

Now, only the platen drum 2 rotates by one more revolution for printing the color of C. During the final printing, by the restore force of the torsion spring 18, the sliding pin 16 is released from the cut 29 by sliding on the cam 30, and the paper holder 15 moves upward to a direction perpendicular to an axis of the driving shaft 12 along the loop hole 19. As a result, the record paper 3 which is printed completely passes the paper holder 15 and is discharged to the discharge tray, as shown in FIG. 5D.

The paper holder 15 rotates with the platen drum 2 until the initial position so as to complete a printing cycle by engaging the first disc clutch 14 with the second disc clutch 22 by the jaw 25 of the lever 24 just before the sliding pin 16 being engaged with the cut 29.

In conclusion, it is possible to reduce a printing time by discharging a record paper right after a printing cycle is complete, and to improve an accuracy of printing by eliminating a position error of the three colors of Y, M and C, thereby enhancing a reliability of a video printer.

While the invention has been particularly shown and described with reference to the preferred specific embodiment thereof, it will be apparent to those who are skilled in the art that in the foregoing changes in form and detail may be made without departing from the spirit and scope of the present invention.

What is claimed is:

1. An apparatus for holding a printable medium on a platen drum, comprising:

a platen shaft disposed in said platen drum, for enabling said platen drum to rotate about a driving shaft, said platen shaft having a first disc clutch disposed on a side surface of said platen shaft of said platen drum;

paper holding means having a vertical bar loosely mounted on one end of said driving shaft of said platen drum, and a horizontal bar connected to said vertical bar extending over a periphery of said platen drum, for pressing said printable medium on said platen drum, said vertical bar of said paper holding means having a second disc clutch disposed on an inner side surface of said vertical bar facing toward said first disc clutch of said platen shaft;

a clutch plate disposed on an outer side surface of said vertical bar of said paper holding means about said driving shaft, for pressing said second disc clutch to be engaged with said first disc clutch of said platen shaft in dependence upon exertion of a lever; and whereby when said disc clutch is engaged with said second disc clutch, said paper holding means moves downward to press said printable medium onto said platen drum to enable a thermal printhead to a plurality of first color ribbons, and when said first disc clutch is disengaged from said second disc clutch, said paper holding means moves upward to release said printable medium from said platen drum to thereby discharge said printable medium immediately after a lost color ribbon is printed by said thermal print head.

2. The apparatus for holding a printable medium as claimed in claim 1, wherein said first and second disc clutches are made of a friction face or a latch.

3. The apparatus for holding a printable medium as claimed in claim 1, wherein said paper holding means is equipped with a sliding pin installed in perpendicular to said platen shaft so that said sliding pin is engaged with a cut having a cam by a torsion spring and slides over said cam, to enable said paper holding means to move upward and downward.

4. The apparatus for holding a printable medium as claimed in claim 1, further comprised of a compression spring disposed around said driving shaft for enabling said clutch plate to slide toward said platen drum.

5. The apparatus for holding a printable medium as claimed in claim 1, further comprised of a loop hole formed on a side surface of said paper holding means for enabling said paper holding means to move upward and downward for holding said printable medium onto said platen drum.

* * * * *